US007361241B2

(12) United States Patent
Barth et al.

(10) Patent No.: US 7,361,241 B2
(45) Date of Patent: Apr. 22, 2008

(54) FILAMENTARY NONWOVEN BANDAGE FABRIC

(75) Inventors: Georg Martin Barth, Rengsdorf (DE); Edmund Hugh Carus, Timothy House Farm, Off Whalley Road, Hurst Green, Clitheroe, Lancashire (GB) BB7 9QJ

(73) Assignees: Fleissner GmbH, Egelsbach (DE); Georg Barth, Rengsdorf (DE); Edmund Hugh Carus, Lancashire (GB)

( * ) Notice: Subject to any disclaimer, the term of this patent is extended or adjusted under 35 U.S.C. 154(b) by 437 days.

(21) Appl. No.: 10/545,132

(22) PCT Filed: Feb. 5, 2004

(86) PCT No.: PCT/GB2004/000382

§ 371 (c)(1),
(2), (4) Date: Aug. 10, 2005

(87) PCT Pub. No.: WO2004/072347

PCT Pub. Date: Aug. 26, 2004

(65) Prior Publication Data

US 2006/0089074 A1 Apr. 27, 2006

(30) Foreign Application Priority Data

Feb. 13, 2003 (GB) ..... 0303295.0

(51) Int. Cl.
*B32B 37/00* (2006.01)

(52) U.S. Cl. ..... 156/85; 156/148; 156/167; 156/183; 156/204; 156/229; 156/296; 156/73.1; 156/308.2

(58) Field of Classification Search ..... 156/167, 156/148, 84, 85, 229, 160, 161, 164, 73.1, 156/73.2, 308.2, 309.6, 296, 180, 183, 204
See application file for complete search history.

(56) References Cited

U.S. PATENT DOCUMENTS 4,209,563 A * 6/1980 Sisson ..... 442/329
5,219,633 A * 6/1993 Sabee ..... 428/109

FOREIGN PATENT DOCUMENTS

| | | | |
|---|---|---|---|
| EP | 0 703 308 | A1 | 3/1996 |
| EP | 0 814 189 | A1 | 12/1997 |
| GB | 1105968 | | 3/1968 |
| JP | A-02-182963 | | 7/1990 |
| JP | A-07-031672 | | 2/1995 |
| WO | WO-92/16366 | A1 * | 10/1992 |
| WO | WO-92/16371 | A1 * | 10/1992 |
| WO | WO-00/63479 | A1 * | 10/2000 |

* cited by examiner

*Primary Examiner*—Jeff H. Aftergut
(74) *Attorney, Agent, or Firm*—Oliff & Berridge, PLC

(57) ABSTRACT

In order to produce a nonwoven fabric having elastomeric properties spun filaments (1), consisting preferably (but not essentially) of cellulose material such as cellulose acetate or solvent spun rayon, not in yarn formats, are corrugated or crimped in an overfeed process, as in stuffer box (6), into stabilized three dimensional batts. A proportion of filaments (3) of a thermal memory material, such as modified polyester, in a stretched format are included. The resulting batt is then subjected to controlled hydroentangling and a controlled heat treatment to yield three dimensional nonwoven fabrics with elastomeric properties due to contraction of the stretched filaments. Elastomeric memory material activated to shrink by ultrasonic treatment may be used in place of thermal memory material. The elastomeric properties can be adjusted to suit end-use requirements and applications are envisaged in the medical and hygiene areas.

8 Claims, 4 Drawing Sheets

FILAMENTARY NONWOVEN BANDAGE FABRIC

This invention concerns the manufacture of three-dimensional elastomeric nonwoven fabrics.

According to the invention, spun filaments, consisting preferably (but not essentially) of cellulosic material such as cellulose acetate or solvent spun rayon, not in yarn formats, are corrugated or crimped (these words being used synonymously herein) under controlled conditions into stabilized three dimensional batts. A proportion of filaments of a thermal memory material in a stretched format are included. These batts are then subjected to carefully controlled hydroentangling and a controlled heating treatment to yield three dimensional nonwoven fabrics with elastomeric properties due to the contraction of the stretched filaments These elastomeric properties can be adjusted to suit end-use requirements. Applications are envisaged in the medical and hygiene areas principally.

Much prior art exists in the area of all cellulose nonwoven fabrics formed from filaments. This is well described in a paper "Advanced Cellulosic Nonwovens" presented at the Insight Conference, San Diego, November 1999 by C. R. Woodings. Despite the wide diversity of processes involved in producing filament bonded rayons, none has resulted in soft, three dimensional, wet resilient structures exhibiting controlled elasticity. Attempts to produce bonded cellulose acetate nonwovens using solvents e.g. triacetin resulted in stiff structures currently used in cigarette filters.

It has now been determined that soft, wet resilient, elastomeric, filamentary nonwoven fabrics can be produced using cellulose acetate or solvent spun rayon filaments and heat shrinkable filaments by a three stage process.

Taking cellulose acetate as a typical embodiment, the first stage is to assemble a multitude of conventionally spun cellulose acetate filaments, and interspace uniformly across such an assembly elastomeric shrinkable filaments in a stretched format. These elastomeric filaments will contract under controlled conditions and draw together all the remaining or adjacent filaments as an elastic band of any predetermined width. The assembly of filaments is then crimped and compressed by an overfeed process, such as a stuffer box or forced air/steam procedure, so that a band of corrugated filaments results. This band exhibits corrugations in all axes, "x", "y" and "z". These filament corrugations and the small degree of filament entanglement which result from such an operation yields a batt with sufficient strength and integrity to withstand machine handling (and packaging if desired) prior to the second stage.

A very simple light bonding technique by, for example, ultrasonic or point bonded thermal methods or specialist tacking by hydroentangling could be undertaken at this stage to further ensure the integrity and bulk of such batts in machine handling or packaging prior to the second stage.

The second stage involves the hydroentanglement and drying of the batt into a 100% filamentary nonwoven structure exhibiting commendable controlled integrity, softness, thickness, wet strength and lint-freeness coupled with thermal insulatory protection. These are essential properties at the end of this second stage.

The third stage involves a final heat treatment which can be applied uniformly or in suitable patterns or arrays to yield an elastomeric bandage type final product. This is due to the contraction of the heat stretched filaments present. Dependent on the pattern of heating applied, products with uniform overall elasticity or patterned elasticity in one or both axes result. On extension, lack of "necking" can be achieved.

Nonwoven materials very similar to those seen, for example, in traditional woven or knitted creped bandage products result but with no yarns present.

Optionally, the completed nonwoven materials can be subjected to a final consolidation operation by appropriate bonding techniques to provide increased tensile strength or enhance other physical properties. Preferred consolidation procedures include thermal or ultrasonic bonding techniques which create raised/embossed zones to provide points or areas of bonding without compressing the nonwoven material.

The process variables in such a three stage operation are such that resultant nonwoven fabrics can be engineered with degrees of controlled elasticity, softness, absorbency and strength to best suit the end use applications. The crimping operation can be varied to yield more or less three dimensionality and the degree and nature of the hydroentangling procedure can also be adjusted to provide different physical properties.

The variables in materials used can also be used to provide specific properties to products produced according to the present invention. It is possible to place two crimping operations in parallel prior to the hydroentanglement second stage. One crimping stage can be used to act on coarser filaments than the other stage thus resulting in filamentary nonwovens with one side exhibiting more surface resistance than the other. Other combinations of crimping stages (the process is not limited to three stages) can yield, for example, "sandwich" type materials with fine filaments surrounded by coarser filaments in the final batt entering the hydroentangling operation.

For this invention, modified polyester filaments which yield heat triggered contraction due to their inherent heat memory and hence product elasticity are preferred. Such filaments are commercially available from companies Trevira and EMS-Grylene. Other polymer systems known to those skilled in the art could also be used. Furthermore contraction could be produced from other technologies such as by specialist ultrasonic techniques.

It is possible to use other types of cellulose, alone or in combination in such a three stage process to yield 100% binder free three-dimensional filament nonwovens. For example, solvent spun cellulose (or "Lyocell") can be utilized as a single layer or in combination with cellulose acetate or it can be used as a total substitute for cellulose acetate. Crimping of solvent spun rayons is facilitated by heat and moisture if stuffer-box techniques are used since these filaments are more difficult to crimp than cellulose acetate.

Further variations will be obvious to those skilled in the art including the incorporation of synthetic filaments such as non-heat contractible polyolefins, polyamides or polyesters as crimped layers.

It is possible to convert the completed nonwoven material into completed bandage products of various types. These products can themselves, without further processing or additions, constitute finished bandages.

Further materials and further applications are possible for nonwovens made as described in this invention in medical and technically related hygiene products. As regards materials, other filament forming polymers to cellulose acetate and other celluloses can be considered. These include, but are not limited to, man-made biodegradable aliphatic polyesters which are based mainly on the industrial polymerisation of monomers such as glycolic acid (PGA), lactic acid (PLA), butyric acid (PHB), valeric acid (PHV) and caprolactone (PCL). These materials may be used in the present invention in combination with elastomeric polymers (in filament forms) as described, instead of or with cellulose acetate or other cellulosic material. These materials and their copolymers have already found application in implants, absorbable sutures, controlled release packaging and degradable films and mouldings, and the same products/end uses could be supplied using the manufacturing process of the present invention.

Alginate filaments can also be incorporated into the present invention, in proportion to the other filament components or as a discrete filamentary layer or layers to provide optimum wound management in a specialist type of wound care dressing.

This invention is illustrated by the following diagrams in which.

Figure 1A:
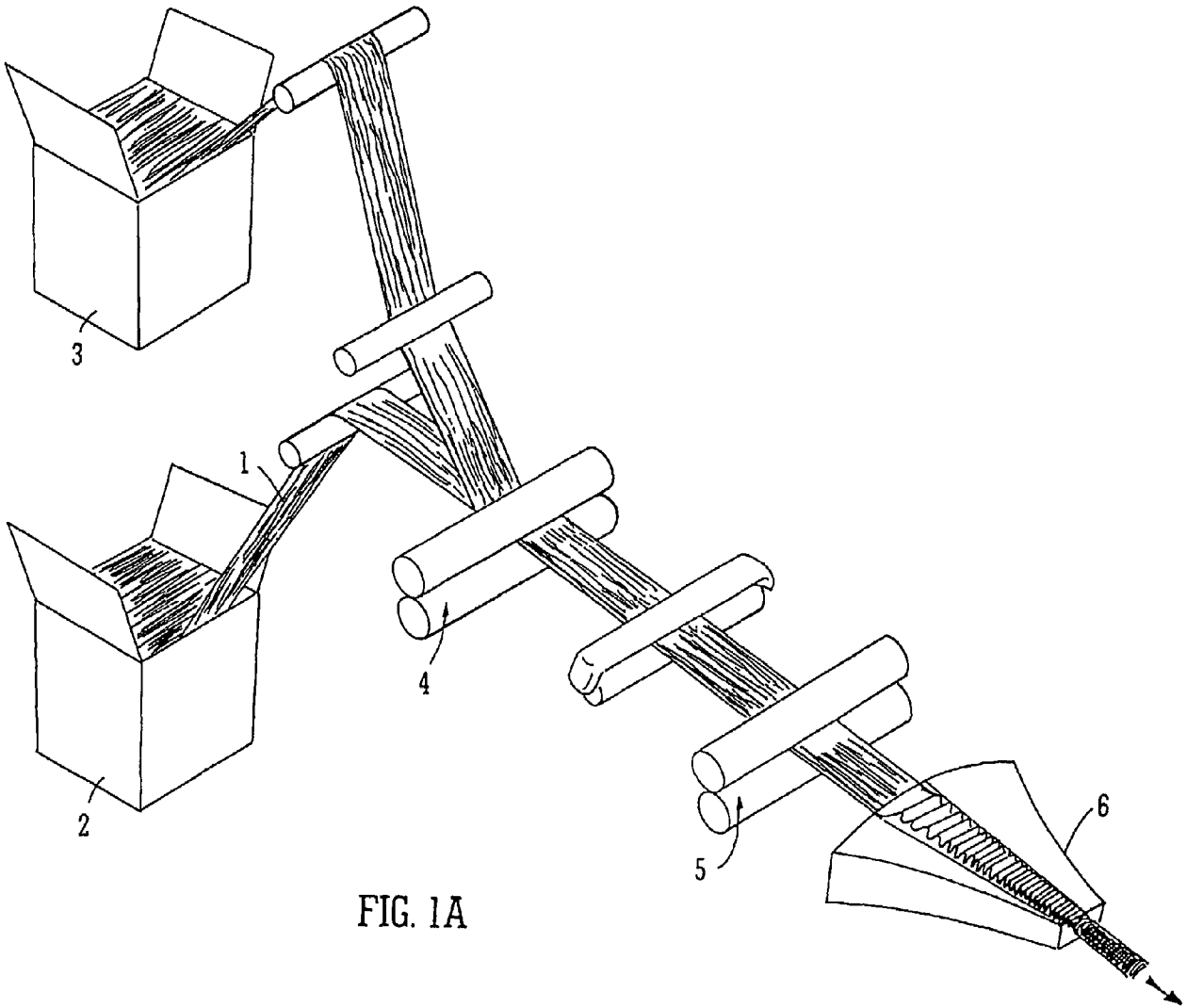
FIGS. 1A and 1B are a general view of a plant suitable for producing a preferred embodiment of the invention.
Figure 1B:
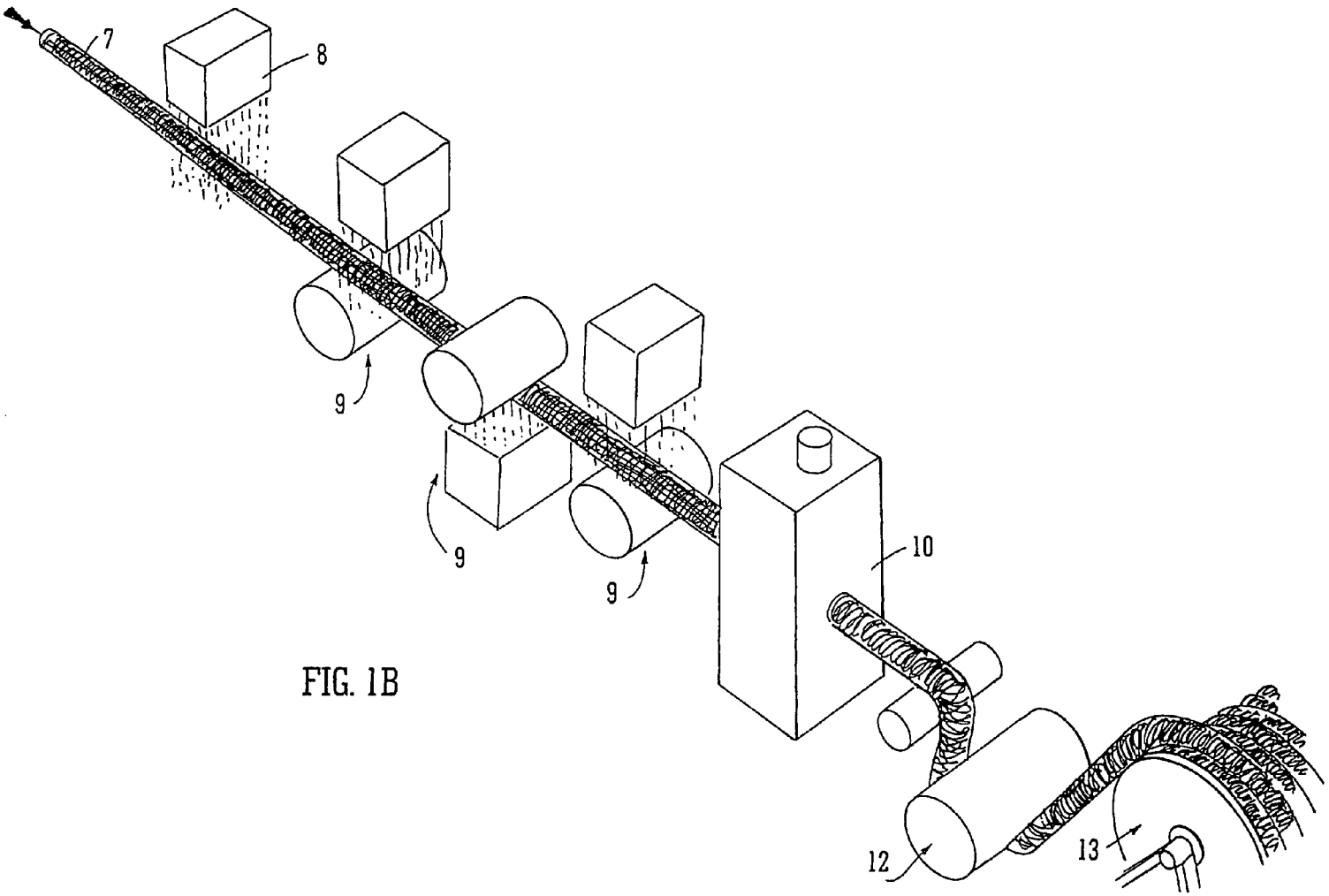

In FIG. 1, a predetermined width of multifilament tow of cellulose acetate (1) as produced by spinning is drawn from a compressed bale (2) while stretched set filaments of an elastomeric memory polyester material are similarly drawn from a separate bale (3). Together, these filaments are stretched longitudinally and laterally between drafting rolls (4) (5) to form a straightened open sheet comprising a plurality of filaments. This sheet then enters a compaction unit (6), which may be a stuffer box as shown, at a greater linear speed than it exits the same. The width of the nonwoven is governed by the settings applied to the compaction unit (6). The resultant batt (7) comprises crimped intertwined filaments with sufficient integrity to withstand gentle handling. In this case, the batt (7) then passes to a second phase of the process where pre-wetting (8) followed by hydroentangling (9) takes place. As a final stage, through-air drying (10), patterned heating to shrink the elastomeric filaments using a specialist heating system (12) and wind up (13) takes place.

Figure 2:
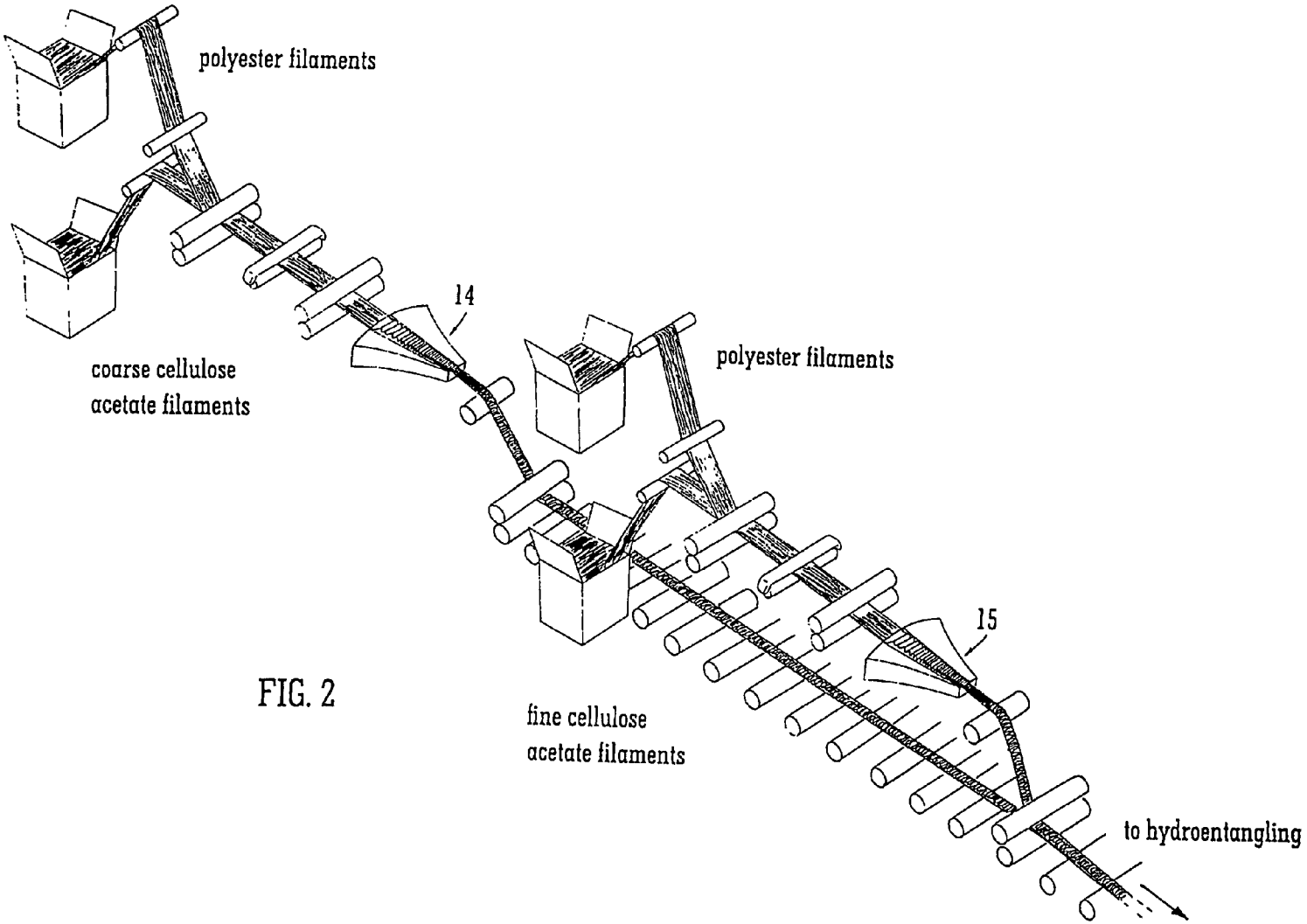
FIG. 2 is a general view of the crimping operation for producing a further embodiment of the invention.

FIG. 2 illustrates another version of the compaction stage of the process whereby two compaction units (14) (15) are used to handle two different thicknesses of cellulose acetate filaments and stretched set polyester filaments, which are then combined as layers in a batt for further processing by hydroentangling.

Figure 3:
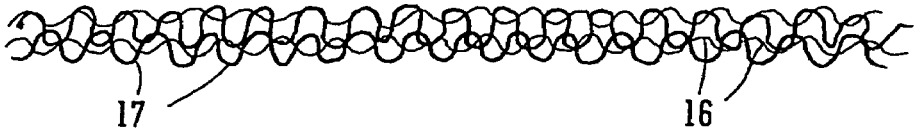
FIG. 3 is a diagrammatic view of a composite structure as described in this invention.

FIG. 3 shows in schematic form the filament deposition and placement in one embodiment of the finished nonwoven fabric and illustrates the reason for the three dimensionality and elasticity of the material. Loops of base material filament (16) and relaxed elastomeric filament (17) are observed passing in the "Z" axis of the nonwoven.

Figure 4:
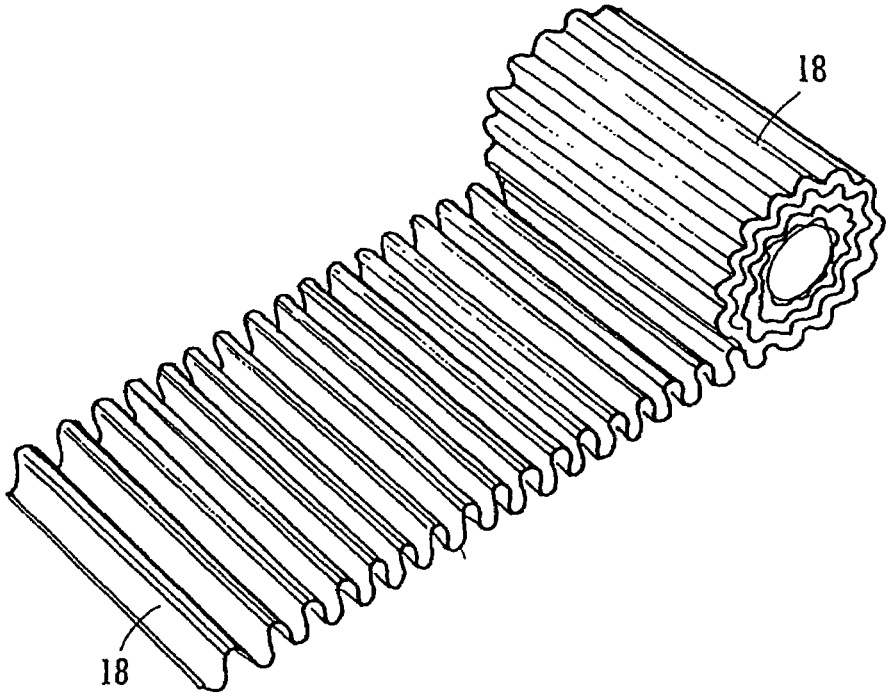
FIG. 4 shows a completed bandage according to the processes described.

FIG. 4 shows, in diagrammatic form, a top perspective of an example of a completed bandage according to the present invention, in this case exhibiting corrugated stretchable areas (18).

Optional additional bonding to provide added handling integrity and strength to the material may then ensue.

The invention claimed is:

1. A method of production of non-woven fabric having elastomeric properties comprising the steps of:

including a proportion of shrinkable filaments of an elastomeric memory material in a substantially parallel array of spun filaments of nonelastomeric material;

corrugating and compacting the resulting filament assembly by means of an overfeed process to form a batt; and subjecting this batt to a hydroentangling operation followed by controlled heat or controlled ultrasonic treatment to shrink the filaments of elastomeric memory material.

2. A method according to claim 1 including a further intermediate step, following formation of the compacted batt, of light bonding of filaments therein by ultrasonic or thermal point bonding techniques or by hydroentanglement at low water pressure.

3. A method according to claim 1 including a further step of embossing the batt, after the elastomeric filaments therein have been shrunk, by thermal or ultrasonic bonding techniques.

4. A method according to claim 1 wherein, prior to the hydroentangling operation, two or more batts are combined as layers or wherein a batt is combined with a layer of a different material.

5. A method according to claim 1 wherein the non-elastomeric filaments comprise cellulose acetate or solvent spun rayon or a combination of these materials.

6. A method according to claim 1 wherein the non-elastomeric filaments include polyesters, polyolefins or polyamides.

7. A method according to claim 1 wherein the elastomeric filaments are modified polyester filaments.

8. A method according to claim 1 wherein the non-elastomeric filaments include alginate filaments.

* * * * *